US012104291B1

(12) United States Patent
Ohno et al.

(10) Patent No.: US 12,104,291 B1
(45) Date of Patent: Oct. 1, 2024

(54) FLAME-RETARDANT FABRIC AND PROTECTIVE CLOTHING MADE OF THE SAME

(71) Applicant: KANEKA CORPORATION, Osaka (JP)

(72) Inventors: Shigeki Ohno, Osaka (JP); Tatsuro Ohzeki, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 0 days.

(21) Appl. No.: 18/250,971

(22) PCT Filed: Dec. 2, 2020

(86) PCT No.: PCT/JP2020/044919

§ 371 (c)(1),
(2) Date: Apr. 27, 2023

(87) PCT Pub. No.: WO2022/118413

PCT Pub. Date: Jun. 9, 2022

(51) Int. Cl.
*D02G 3/44* (2006.01)
*D02G 3/04* (2006.01)
*A41D 31/08* (2019.01)

(52) U.S. Cl.
CPC ..... *D02G 3/443* (2013.01); *D02G 3/04* (2013.01); *D02G 3/449* (2013.01); *D10B 2401/04* (2013.01); *D10B 2501/04* (2013.01)

(58) Field of Classification Search
CPC ..... D02G 3/443; D02G 3/04; D02G 3/449; D10B 2401/04; D10B 2501/04
See application file for complete search history.

(56) References Cited

U.S. PATENT DOCUMENTS

| | | | | |
|---|---|---|---|---|
| 8,003,555 | B2 * | 8/2011 | Tanaka | D01F 6/40 428/296.7 |
| 9,091,000 | B2 * | 7/2015 | Mizobuchi | D03D 15/513 |
| 9,370,212 | B2 * | 6/2016 | Zhu | A41D 31/06 |
| 10,450,679 | B2 * | 10/2019 | Matsumoto | D03D 15/513 |
| 10,577,724 | B2 * | 3/2020 | Ohzeki | D06M 15/673 |
| 11,198,957 | B2 * | 12/2021 | Sato | D03D 15/225 |
| 11,905,630 | B2 * | 2/2024 | Kalantari | D04B 1/123 |
| 2008/0057807 | A1 | 3/2008 | Tutterow et al. | |
| 2008/0153373 | A1 * | 6/2008 | Hall | D04H 1/559 442/148 |
| 2010/0112312 | A1 | 5/2010 | Tutterow et al. | |
| 2011/0023206 | A1 | 2/2011 | Dunn et al. | |
| 2011/0275263 | A1 | 11/2011 | Li et al. | |
| 2013/0055490 | A1 | 3/2013 | Zhu | |
| 2013/0055491 | A1 | 3/2013 | Zhu | |
| 2013/0139306 | A1 | 6/2013 | Zhu | |
| 2013/0196135 | A1 * | 8/2013 | Li | C08G 73/08 428/221 |
| 2013/0247287 | A1 * | 9/2013 | Mizobuchi | D01F 6/40 428/221 |
| 2014/0026303 | A1 | 1/2014 | Zhu | |
| 2015/0086758 | A1 | 3/2015 | Tutterow et al. | |
| 2017/0167058 | A1 | 6/2017 | Tutterow et al. | |
| 2018/0002840 | A1 | 1/2018 | Tutterow et al. | |
| 2018/0057973 | A1 * | 3/2018 | Yang | D02G 3/441 |
| 2018/0127899 | A1 | 5/2018 | Tutterow et al. | |
| 2018/0371647 | A1 | 12/2018 | Sato et al. | |
| 2019/0343204 | A1 * | 11/2019 | Li | D03D 15/513 |
| 2020/0085122 | A1 * | 3/2020 | Li | D02G 3/443 |
| 2022/0389627 | A1 * | 12/2022 | Ringo, Jr. | D02G 3/443 |
| 2022/0389628 | A1 * | 12/2022 | Ringo, Jr. | D02G 3/443 |
| 2023/0018241 | A1 * | 1/2023 | Boyette | D02G 3/443 |

FOREIGN PATENT DOCUMENTS

| | | | |
|---|---|---|---|
| EP | 3 425 093 | A1 | 1/2019 |
| JP | 2009-519383 | A | 5/2009 |
| JP | 2010-502849 | A | 1/2010 |
| JP | 2014-525520 | A | 9/2014 |
| JP | 2014-210985 | A | 11/2014 |
| JP | 2014-529690 | A | 11/2014 |
| JP | 2015-505913 | A | 2/2015 |

(Continued)

OTHER PUBLICATIONS

International Search Report issued in PCT/JP2020/044919; mailed Feb. 2, 2021.

*Primary Examiner* — Robert H Muromoto, Jr.
(74) *Attorney, Agent, or Firm* — Studebaker & Brackett PC

(57) ABSTRACT

One or more embodiments of the present invention relate to a flame-retardant fabric that includes modacrylic fibers, regenerated cellulose fibers, and heat-resistant fibers. The regenerated cellulose fibers include one or more regenerated cellulose fibers selected from the group consisting of flame-retardant rayon fibers and lyocell fibers. The heat-resistant fibers include one or more heat-resistant fibers selected from the group consisting of polyoxadiazole fibers and aramid fibers. The flame-retardant fabric includes the modacrylic fibers in an amount of 20 to 76 wt %, the regenerated cellulose fibers in an amount of 11 to 48 wt %, and the heat-resistant fibers in an amount of 6 to 69 wt %. The char length, afterflame time, and afterglow time of the flame-retardant fabric measured using a flammability test in accordance with GB/T 5455-1997 are 100 mm or less, 2 seconds or less, and 4 seconds or less, respectively. Thus, provided are a flame-retardant fabric that has favorable flame retardancy and antimicrobial properties, and protective clothing made of the flame-retardant fabric.

14 Claims, No Drawings

(56) References Cited

FOREIGN PATENT DOCUMENTS

| | | | |
|---|---|---|---|
| JP | 2015-530485 | A | 10/2015 |
| WO | 2008/027454 | A1 | 3/2008 |
| WO | 2008/048308 | A2 | 4/2008 |
| WO | 2011/143076 | A2 | 11/2011 |
| WO | 2013/032562 | A1 | 3/2013 |
| WO | 2013/032563 | A1 | 3/2013 |
| WO | 2013/085726 | A1 | 6/2013 |
| WO | 2014/018697 | A1 | 1/2014 |
| WO | 2016/194766 | A1 | 12/2016 |
| WO | 2017/150341 | A1 | 9/2017 |

* cited by examiner

FLAME-RETARDANT FABRIC AND PROTECTIVE CLOTHING MADE OF THE SAME

TECHNICAL FIELD

The present invention relates to a flame-retardant fabric and protective clothing made of the flame-retardant fabric.

Background Art

Firefighters and workers in environments exposed to the risk of flames, such as workplaces in the fields of petroleum, petrochemistry, coal mining, electric power, welding, metalwork, and the like, require flame-retardant protective clothing. Fabrics with various configurations have been proposed as fabrics for flame-retardant protective clothing. For example, Patent Document 1 proposes a flame-retardant fabric that includes FR modacrylic fibers in an amount of 40 to 50%, Tencel (registered trademark) fibers in an amount of 30 to 40%, and aramid fibers in an amount of 10 to 15%. Patent Document 2 proposes a fabric made of flame-retardant yarn that includes polyoxadiazole fibers in an amount of 60 to 85 wt % and modacrylic fibers in an amount of 15 to 40 wt %.

PRIOR ART DOCUMENTS

Patent Documents

Patent Document 1: JP 2010-502849A
Patent Document 2: JP 2015-505913A

DISCLOSURE OF INVENTION

Problem to be Solved by the Invention

However, the char lengths and afterglow times of the flame-retardant fabrics disclosed in Patent Documents 1 and 2 may increase in a flammability test. Accordingly, the flame retardancy needs to be improved. Furthermore, recently, antimicrobial properties are imparted to fabrics for clothing in terms of health consciousness.

In order to solve the aforementioned conventional problems, the present invention provides a flame-retardant fabric that has favorable flame retardancy and antimicrobial properties, and protective clothing made of the flame-retardant fabric.

Means for Solving Problem

One or more embodiments of the present invention relate to a flame-retardant fabric that includes modacrylic fibers, regenerated cellulose fibers, and heat-resistant fibers. The regenerated cellulose fibers comprise one or more regenerated cellulose fibers selected from the group consisting of flame-retardant rayon fibers and lyocell fibers. The heat-resistant fibers comprise one or more heat-resistant fibers selected from the group consisting of polyoxadiazole fibers and aramid fibers. The flame-retardant fabric includes the modacrylic fibers in an amount of 20 to 76 wt %, the regenerated cellulose fibers in an amount of 11 to 48 wt %, and the heat-resistant fibers in an amount of 6 to 69 wt %. The char length, afterflame time, and afterglow time of the flame-retardant fabric measured using a flammability test in accordance with GB/r 5455-1997 are 100 mm or less, 2 seconds or less, and 4 seconds or less, respectively.

The present invention also relates to protective clothing made of the flame-retardant fabric.

Effects of the Invention

The present invention can provide a flame-retardant fabric that has favorable flame retardancy and antimicrobial properties, and protective clothing made of the flame-retardant fabric.

DESCRIPTION OF INVENTION

The inventors of the present invention found that, in the case of a fabric that included predetermined amounts of modacrylic fibers, one or more regenerated cellulose fibers selected from the group consisting of flame-retardant rayon fibers and lyocell fibers, and one or more heat-resistant fibers selected from the group consisting of polyoxadiazole fibers and aramid fibers, the flame retardancy was improved, and thus the char length, afterflame time, and afterglow time of the fabric decreased in a flammability test. Furthermore, a particularly surprising discovery was that it was also possible to impart antimicrobial properties to the fabric. In one or more embodiments of the present invention, the "char length", "afterflame time", and "afterglow time" can be measured using a flammability test in accordance with GB/T 5455-1997. Note that, in one or more embodiments of the present invention, "GB" means the "Chinese National Standard". In one or more embodiments of the present invention, the "antimicrobial properties" can be measured using an antimicrobial test in accordance with IS020743.

The modacrylic fibers are preferably made of an acrylonitrile copolymer formed through copolymerization of acrylonitrile in an amount of 35 to 85 wt % and another component in an amount of 15 to 65 wt %. From the viewpoint of the flame retardancy and the antimicrobial properties, it is preferable to use, as the other component, one or more components selected from, for example, the group consisting of halogen-containing vinyl monomers and halogen-containing vinylidene monomers. The content of acrylonitrile in the acrylonitrile copolymer is more preferably 35 to 65 wt %. The contents of a halogen-containing vinyl monomer and/or a halogen-containing vinylidene monomer in the acrylonitrile copolymer are more preferably 35 to 65 wt %. The acrylonitrile copolymer may further include a monomer having a sulfonic group. The content of a monomer having a sulfonic group in the acrylonitrile copolymer is preferably 0 to 3 wt %.

From the viewpoint of the flame retardancy and the antimicrobial properties, the acrylonitrile copolymer preferably includes acrylonitrile in an amount of 35 to 85 wt %, one or more halogen-containing monomers selected from the group consisting of halogen-containing vinyl monomers and halogen-containing vinylidene monomers in an amount of 15 to 65 wt %, and a monomer having a sulfonic group in an amount of 0 to 3 wt %, and more preferably includes acrylonitrile in an amount of 40 to 75 wt %, one or more halogen-containing monomers selected from the group consisting of halogen-containing vinyl monomers and halogen-containing vinylidene monomers in an amount of 24.5 to 60 wt %, and a monomer having a sulfonic group in an amount of 0.5 to 3 wt %.

When the content of acrylonitrile in the acrylonitrile copolymer is 35 to 85 wt %, the modacrylic fibers have favorable fiber physical properties, and thus the flame-retardant fabric that includes the modacrylic fibers also has favorable physical properties.

When the contents of the halogen-containing vinyl monomer and/or the halogen-containing vinylidene monomer in the acrylonitrile copolymer are 15 to 65 wt %, the modacrylic fibers have favorable flame retardancy, and thus the flame-retardant fabric that includes the modacrylic fibers also has favorable flame retardancy.

Examples of the halogen-containing vinyl monomers include vinyl chloride and vinyl bromide, but there is no particular limitation thereto. Examples of the halogen-containing vinylidene monomers include vinylidene chloride and vinylidene bromide, but there is no particular limitation thereto. The halogen-containing vinyl monomers and the halogen-containing vinylidene monomers maybe used alone or in combination of two or more.

Examples of the monomer having a sulfonic group include methacrylsulfonic acid, allylsulfonic acid, styrenesulfonic acid, 2-acrylamide-2-methylpropanesulfonic acid, and salts thereof but there is no particular limitation thereto. Examples of the salts include sodium salts, potassium salts, and ammonium salts, but there is no limitation thereto. The monomers having a sulfonic group may be used alone or in combination of two or more. The monomer having a sulfonic group is used as necessary, but when the content of the monomer having a sulfonic group in the acrylonitrile copolymer is 3 wt % or less, the production stability in the spinning process is excellent.

It is preferable that the modacrylic fibers contain an antimony compound. The content of the antimony compound in the modacrylic fibers is 3.9 to 20 wt %, preferably 4.2 to 18 wt %, more preferably 4.5 to 16 wt %, and even more preferably 4.7 to 14 wt %, with respect to the overall weight of the fibers. When the content of the antimony compound is within the above-described range, the char length is more likely to decrease in a flammability test, and the afterglow time also decreases.

From the viewpoint of production stability in the spinning process, the antimony compound is preferably one or more compounds selected from the group consisting of antimony trioxide, antimony tetroxide, and antimony pentoxide, but there is no particular limitation thereto.

In one or more aspects of the present invention, the flame-retardant fabric includes the modacrylic fibers in an amount of 20 to 76 wt %. If the content of the modacrylic fibers is less than 20 wt %, the flame retardancy and antimicrobial properties will be poor. If the content of the modacrylic fibers exceeds 76 wt %, the contents of the regenerated cellulose fibers and the heat-resistant fibers will be excessively small, which leads to poor flame retardancy. In one or more aspects of the present invention, the flame-retardant fabric preferably includes the modacrylic fibers in an amount of 25 to 65 wt %, more preferably 30 to 65 wt %, and even more preferably 35 to 60 wt %.

It is preferable that rayon fibers containing a phosphorus-based flame retardant are used as the flame-retardant rayon fibers. Examples of the phosphorus-based flame retardant include phosphoric ester-based compounds, halogen-containing phosphoric ester-based compounds, condensed phosphoric ester-based compounds, polyphosphate-based compounds, and polyphosphoric ester-based compounds, but there is no particular limitation thereto. The flame-retardant rayon fibers containing the phosphorus-based flame retardant preferably include, for example, the phosphorus-based flame retardant in an amount of 0.5 wt % or more, and more preferably 0.8 wt % or more, with respect to the overall weight of the fibers, but there is no particular limitation thereto. For example, commercially available flame-retardant rayon fibers such as flame-retardant rayon "Lenzing FR (registered trademark)" manufactured by Lenzing and flame-retardant rayon "JWELL FR (trademark)" manufactured by Jilin Chemical Fibre Co., Ltd may also be used as the flame-retardant rayon fibers containing the phosphorus-based flame retardant.

The flame-retardant fabric includes phosphorus in an amount of 0.3 wt % or more, preferably 0.4 wt % or more, and more preferably 0.5 wt % or more, with respect to the overall weight of the fabric. When the content of phosphorus in the flame-retardant fabric is 0.3 wt % or more, the char length is more likely to decrease, and the flame retardancy is further improved. Note that, although there is no particular limitation on the upper limit of the content of phosphorus in the flame-retardant fabric, the content of phosphorus is preferably 1.1 wt % or less with respect to the overall weight of the fabric from the viewpoint of further reducing the char length of the flame-retardant fabric. The content of phosphorus in the flame-retardant fabric can be measured using a fluorescent X-ray analysis method.

In one or more embodiments of the present invention, the flame-retardant fabric includes the one or more regenerated cellulose fibers selected from the group consisting of flame-retardant rayon fibers and lyocell fibers in an amount of 11 to 48 wt %. Thus, the flame retardancy is improved, and in particular, an excellent texture and excellent moisture absorbency can be imparted while the afterglow time is reduced. In one or more embodiments of the present invention, the flame-retardant fabric preferably includes the regenerated cellulose fibers in an amount of 17 to 48 wt %, more preferably 18 to 45 wt %, and even more preferably 20 to 40 wt %.

From the viewpoint of further improving the flame retardancy, when the flame-retardant fabric includes the modacrylic fibers made of an acrylonitrile copolymer formed through copolymerization of acrylonitrile and a vinyl halide monomer, the flame-retardant fabric preferably includes flame-retardant rayon fibers as the regenerated cellulose fibers.

In one or more embodiments of the present invention, fibers made of a polyoxadiazole polymer that includes an oxadiazole unit can be used as the polyoxadiazole fibers, for example. Examples of the polyoxadiazole polymer include a polyarylene-1,3,4-oxadiazole polymer, a polyarylene-1,2,4-oxadiazole polymer, and a mixture thereof, and a copolymer of poly-para-phenylene-1,3,4-oxadiazole and poly-meta-phenylene-1,3,4-oxadiazole is preferable. For example, commercially available polyoxadiazole fibers such as Oxalon (registered trademark), Arselon (registered trademark), Arselon-C (registered trademark), Arselon-S (registered trademark), and POD-Z fibers can be used.

In one or more embodiments of the present invention, meta-aramid fibers and para-aramid fibers can be used as the aramid fibers. It is preferable to use meta-aramid fibers and para-aramid fibers together from the viewpoint of reducing the char length and improving the flame retardancy.

In one or more embodiments of the present invention, the flame-retardant fabric includes one or more heat-resistant fibers selected from the group consisting of polyoxadiazole fibers and aramid fibers in an amount of 6 to 69 wt %. Thus, the flame retardancy is improved, and in particular, the char length can be reduced. If the content of the heat-resistant fibers exceeds 69 wt %, the antimicrobial properties are impaired, and thus necessary antimicrobial properties cannot be ensured. In one or more embodiments of the present invention, the flame-retardant fabric preferably includes the heat-resistant fibers in an amount of 6 to 63 wt %, more preferably 6 to 55 wt %, and even more preferably 8 to 50 wt %.

In one or more embodiments of the present invention, from the viewpoint of achieving both the flame retardancy and the antimicrobial properties, the flame-retardant fabric preferably includes the modacrylic fibers in an amount of 20 to 76 wt %, the regenerated cellulose fibers in an amount of 11 to 48 wt %, and the polyoxadiazole fibers in an amount of 6 to 69 wt %, more preferably includes the modacrylic fibers in an amount of 20 to 76 wt %, the regenerated cellulose fibers in an amount of 17 to 48 wt %, and the polyoxadiazole fibers in an amount of 6 to 63 wt %, even more preferably includes the modacrylic fibers in an amount of 25 to 65 wt %, the regenerated cellulose fibers in an amount of 18 to 45 wt %, and the polyoxadiazole fibers in an amount of 6 to 55 wt %, and particularly preferably includes the modacrylic fibers in an amount of 30 to 65 wt %, the regenerated cellulose fibers in an amount of 20 to 40 wt %, and the polyoxadiazole fibers in an amount of 8 to 50 wt %.

In one or more embodiments of the present invention, from the viewpoint of achieving both the flame retardancy and the antimicrobial properties, the flame-retardant fabric preferably includes the modacrylic fibers in an amount of 20 to 76 wt %, the flame-retardant rayon fibers in an amount of 11 to 25 wt %, the lyocell fibers in an amount of 0 to 20 wt %, and the polyoxadiazole fibers in an amount of 6 to 69 wt %, preferably includes the modacrylic fibers in an amount of 20 to 76 wt %, the flame-retardant rayon fibers in an amount of 15 to 25 wt %, the lyocell fibers in an amount of 10 to 20 wt %, and the polyoxadiazole fibers in an amount of 6 to 62 wt %, more preferably includes the modacrylic fibers in an amount of 25 to 65 wt %, the flame-retardant rayon fibers in an amount of 15 to 25 wt %, the lyocell fibers in an amount of 10 to 20 wt %, and the polyoxadiazole fibers in an amount of 6 to 55 wt %, and even more preferably includes the modacrylic fibers in an amount of 30 to 65 wt %, the flame-retardant rayon fibers in an amount of 15 to 25 wt %, the lyocell fibers in an amount of 10 to 20 wt %, and the polyoxadiazole fibers in an amount of 8 to 50 wt %.

In one or more embodiments of the present invention, from the viewpoint of improving the flame retardancy, when the flame-retardant fabric includes the polyoxadiazole fibers in an amount of 30 wt % or more, the flame-retardant fabric preferably includes the flame-retardant rayon fibers in an amount of 20 wt % or more. For example, the flame-retardant fabric may include the modacrylic fibers in an amount of 20 to 50 wt %, the flame-retardant rayon fibers in an amount of 20 to 48 wt %, and the polyoxadiazole fibers in an amount of 30 to 60 wt %. On the other hand, in one or more embodiments of the present invention, when the flame-retardant fabric includes the polyoxadiazole fibers in an amount of less than 30 wt %, the flame-retardant fabric need not include the flame-retardant rayon fibers. Specifically, the flame-retardant fabric may include the modacrylic fibers in an amount of 20 to 50 wt %, the lyocell fibers in an amount of 18 to 48 wt %, and the polyoxadiazole fibers in an amount of 6 to 29 wt %.

In one or more embodiments of the present invention, from the viewpoint of achieving both the flame retardancy and the antimicrobial properties, the flame-retardant fabric preferably includes the modacrylic fibers in an amount of 20 to 52 wt %, the regenerated cellulose fibers in an amount of 17 to 48 wt %, and the aramid fibers in an amount of 30 to 63 wt %, with meta-aramid fibers being included in an amount of 20 wt % or more as the aramid fibers, more preferably includes the modacrylic fibers in an amount of 25 to 52 wt %, the regenerated cellulose fibers in an amount of 18 to 45 wt %, the meta-aramid fibers in an amount of 25 to 50 wt %, and para-aramid fibers in an amount of 5 to 30 wt %, and even more preferably includes the modacrylic fibers in an amount of 30 to 52 wt %, the regenerated cellulose fibers in an amount of 18 to 40 wt %, the meta-aramid fibers in an amount of 25 to 45 wt %, and para-aramid fibers in an amount of 5 to 25 wt %. Moreover, from the viewpoint of further improving the flame retardancy, the mass ratio between the meta-aramid fibers and the para-aramid fibers (meta: para) in the flame-retardant fabric is preferably 1:0.9 to 1:1.1.

In one or more embodiments of the present invention, from the viewpoint of achieving both the flame retardancy and the antimicrobial properties, the flame-retardant fabric preferably includes the modacrylic fibers in an amount of 20 to 52 wt %, the flame-retardant rayon fibers in an amount of 11 to 25 wt %, the lyocell fibers in an amount of 7 to 20 wt %, and the aramid fibers in an amount of 30 to 62 wt %, with meta-aramid fibers being included in an amount of 20 wt % or more as the aramid fibers, more preferably includes the modacrylic fibers in an amount of 25 to 52 wt %, the flame-retardant rayon fibers in an amount of 11 to 25 wt %, the lyocell fibers in an amount of 7 to 20 wt %, the meta-aramid fibers in an amount of 25 to 50 wt %, and para-aramid fibers in an amount of 5 to 30 wt %, and even more preferably includes the modacrylic fibers in an amount of 30 to 52 wt %, the flame-retardant rayon fibers in an amount of 11 to 25 wt %, the lyocell fibers in an amount of 7 to 20 wt %, the meta-aramid fibers in an amount of 25 to 45 wt %, and para-aramid fibers in an amount of 5 to 25 wt %.

In one or more embodiments of the present invention, from the viewpoint of achieving both the flame retardancy and the antimicrobial properties, the flame-retardant fabric preferably includes the modacrylic fibers in an amount of 20 to 52 wt %, the flame-retardant rayon fibers in an amount of 17 to 48 wt %, and the aramid fibers in an amount of 30 to 63 wt %, with meta-aramid fibers being included in an amount of 20 wt % or more as the aramid fibers, more preferably includes the modacrylic fibers in an amount of 25 to 52 wt %, the flame-retardant rayon fibers in an amount of 18 to 45 wt %, the aramid fibers in an amount of 25 to 50 wt %, and para-aramid fibers in an amount of 5 to 30 wt %, and even more preferably includes the modacrylic fibers in an amount of 30 to 52 wt %, the flame-retardant rayon fibers in an amount of 18 to 40 wt %, the meta-aramid fibers in an amount of 25 to 45 wt %, and para-aramid fibers in an amount of 5 to 25 wt %.

From the viewpoint of the strength and the productivity in the spinning process, for example, as the modacrylic fibers, the flame-retardant rayon fibers, the lyocell fibers, the polyoxadiazole fibers, the meta-aramid fibers, and the para-aramid fibers, short fibers thereof having a fiber length of 30 to 127 mm, preferably 45 to 127 mm, more preferably 45 to 76 mm, and even more preferably 45 to 64 mm, can be used as appropriate.

The flame-retardant fabric may include other fibers as long as the object and the effects of the present invention are not inhibited. Examples of the other fibers include conductive fibers, nylon fibers, and polyester fibers. The flame-retardant fabric may include the other fibers in an amount of 5 wt % or less, 3 wt % or less, or 1 wt % or less.

From the viewpoint of the strength and the productivity in the spinning process, for example, as the other fibers, short fibers thereof having a fiber length of 30 to 127 mm, preferably 45 to 127 mm, more preferably 45 to 76 mm, and even more preferably 45 to 64 mm, can be used as appropriate.

From the viewpoint of the strength of the flame-retardant fabric, all of the modacrylic fibers, the flame-retardant rayon fibers, the lyocell fibers, the polyoxadiazole fibers, the meta-aramid fibers, the para-aramid fibers, and the other fibers preferably have a single fiber fineness of 1 to 20 dtex, and more preferably 1.5 to 15 dtex.

From the viewpoint of the flexibility and feel, the basis weight of the flame-retardant fabric is preferably 100 to 500 $g/m^2$, more preferably 130 to 480 $g/m^2$, and even more preferably 150 to 460 $g/m^2$, but there is no particular limitation thereto.

The form of the flame-retardant fabric is not particularly limited, and examples thereof include a woven fabric and a knitted fabric. There is no particular limitation on the weave of the woven fabric. Three foundation weaves such as a plain weave, a twill weave, and a sateen weave may be applied, and a patterned woven fabric obtained by using a special loom such as a dobby loom or a Jacquard loom may be used. Also, there is no particular limitation on the knitting of the knitted fabric, and any of circular knitting, flat knitting, and warp knitting may be applied. The flame-retardant fabric is preferably a woven fabric, and more preferably a twill woven fabric, in terms of excellent durability.

In one or more embodiments of the present invention, the flame-retardant fabric has excellent flame retardancy, and its char length, afterflame time, and afterglow time measured using a flammability test in accordance with GB/F 5455-1997 are 100 mm or less, 2 seconds or less, and 4 seconds or less, respectively. Thus, the class-B standard for "flame-retardant protective clothing" specified in GB 8965.1-2009 will be satisfied. It is preferable that the char length, afterflame time, and afterglow time of the flame-retardant fabric measured using a flammability test in accordance with GB/T 5455-1997 are 100 mm or less, 2 seconds or less, and 4 seconds or less, respectively, after the flame-retardant fabric has been washed 50 times in accordance with GB/F 17596-1998.

In one or more embodiments of the present invention, from the viewpoint of further improving the flame-retardancy, it is preferable that the char length, afterflame time, and afterglow time of the flame-retardant fabric measured using a flammability test in accordance with GB/r 5455-1997 are 50 mm or less, 2 seconds or less, and 2 seconds or less, respectively. Thus, the class-A standard for "flame-retardant protective clothing" specified in GB 8965.1-2009 will be satisfied. It is more preferable that the char length, afterflame time, and afterglow time of the flame-retardant fabric measured using a flammability test in accordance with GB/P 5455 1997 is 50 mm or less, 2 seconds or less, and 2 seconds or less, respectively, after the flame-retardant fabric has been washed 50 times in accordance with GB/F 17596-1998.

In one or more embodiments of the present invention, from the viewpoint of excellent antimicrobial properties, the antimicrobial activity value A of the flame-retardant fabric measured using an antimicrobial test in accordance with IS020743 is preferably 2 or more, and more preferably 3 or more.

In one or more embodiments of the present invention, from the viewpoint of excellent washing-durable antimicrobial properties, the antimicrobial activity value A of the flame-retardant fabric measured using an antimicrobial test in accordance with IS020743 is preferably 2 or more, and more preferably 3 or more, after the flame-retardant fabric has been washed 10 times.

In one or more embodiments of the present invention, the flame-retardant fabric can be favorably used as a fabric for protective clothing required to have flame retardancy. In one or more embodiments of the present invention, the protective clothing can be manufactured using the flame-retardant fabric through a known sewing method. In one or more embodiments of the present invention, the flame-retardant fabric has excellent flame retardancy and antimicrobial properties, and thus the protective clothing also has excellent flame retardancy and antimicrobial properties. Also, the flame-retardant fabric has excellent flame retardancy and antimicrobial properties even after being washed repeatedly, and thus the protective clothing retains flame retardancy and antimicrobial properties even after being washed repeatedly. In one or more embodiments of the present invention, the protective clothing can be used in any type of work in which flame retardancy is required. For example, the protective clothing can be used as protective clothing (firefighting clothing) to be worn by a firefighter, protective clothing to be worn in workplaces in the fields of petroleum, petrochemistry, coal mining, electric power, welding, and the like in which accidents such as a fire may happen, and protective clothing to be worn in workplaces in the fields of metalwork and the like in which accidents such as a dust explosion are likely to happen, but there is no particular limitation thereto.

EXAMPLES

Hereinafter, the present invention will be described in detail by way of examples. However, the present invention is not limited to the examples.

The following fibers were used in examples and comparative examples.

Fibers

Modacrylic fibers I: modacrylic fibers made of an acrylic copolymer containing acrylonitrile in an amount of 49.5 wt %, vinyl chloride in an amount of 49.5 wt %, and sodium styrenesulfonate in an amount of 1.0 wt %, and containing antimony trioxide in an amount of 9.1 wt % with respect to the overall weight of the fibers; single fiber fineness: 1.7 dtex; fiber length: 51 mm.

Modacrylic fibers II: modacrylic fibers made of an acrylic copolymer containing acrylonitrile in an amount of 49.5 wt %, vinylidene chloride in an amount of 49.5 wt %, and sodium styrenesulfonate in an amount of 1.0 wt %, and containing antimony trioxide in an amount of 9.1 wt % with respect to the overall weight of the fibers; single fiber fineness: 1.7 dtex; fiber length: 51 mm.

Flame-retardant rayon fibers: "Lenzing FR" manufactured by Lenzing, containing a phosphorus-based flame retardant; single fiber fineness: 2.2 dtex; fiber length: 51 mm.

Lyocell fibers: "Tencel (registered trademark)" manufactured by Lenzing; single fiber fineness: 1.3 dtex; fiber length: 51 mm.

Polyoxadiazole fibers: "POD-Z" manufactured by Jiangsu POD New Materials Co., Ltd; single fiber fineness: 1.7 dtex; fiber length: 51 mm.

Meta-aramid fibers: "Newstar (registered trademark)" manufactured by Yantai Tayho Advanced Materials Co., Ltd; single fiber fineness: 1.7 dtex; fiber length: 51 mm.

Para-aramidfibers: "Taparan (registered trademark)" manufactured by Yantai Tayho Advanced Materials Co., Ltd; single fiber fineness: 1.7 dtex; fiber length: 51 mm.

Examples 1 to 14, Comparative Examples 1 to 8

The fibers shown in Tables 1 and 2 below were mixed in accordance with the blend amounts shown in Tables 1 and 2 below to manufacture spun yarns of cotton count Nos. shown in Tables 1 and 2 below. These spun yarns were used to produce plain-knitted fabrics having a basis weight shown in Tables 1 and 2 below using a common manufacturing method Examples 15 to 19, Comparative Example 9

The fibers shown in Table 3 below were mixed in accordance with the blend amounts shown in Table 3 below to manufacture spun yarns of cotton count Nos. shown in Table 3 below. These spun yarns were used as warp and weft to produce woven fabrics with weaves shown in Table 3 below using a common manufacturing method. The number of picks was as shown in Table 3 below.

Examples 20 to 22, Comparative Examples 10 and 11

The fibers shown in Table 4 below were mixed in accordance with the blend amounts shown in Table 4 below to manufacture spun yarns of cotton count Nos. shown in Table 4 below. These spun yarns were used as warp and weft to produce woven fabrics with weaves shown in Table 4 below using a common manufacturing method. The number of picks was as shown in Table 4 below.

Examples 23 to 36, Comparative Examples 12 and 13

The fibers shown in Tables 5 and 6 below were mixed in accordance with the blend amounts shown in Tables 5 and 6 below to manufacture spun yarns of cotton count Nos. shown in Tables 5 and 6 below. These spun yarns were used to produce plain-knitted fabrics having a basis weight shown in Tables 5 and 6 below using a common manufacturing method.

The flame retardancy and antimicrobial properties of each of the fabrics obtained in the examples and comparative examples were measured and evaluated as follows. Tables 1 to 6 show the results.

Flame Retardancy

A flammability test was performed in accordance with GB/T 5455-1997 to measure the char length (the length of a carbonized portion), afterflame time, and afterglow time of the fabric.

Antimicrobial Properties

An antimicrobial test in accordance with IS020743 was performed to measure the antimicrobial activity value A through a bacterial suspension absorption method. The fabrics were washed 10 times in accordance with GB/P 17596-1998 and were then used as samples.

If the antimicrobial activity value A is 2 or more, a sample is evaluated as having antimicrobial effects, and if the antimicrobial activity value A is 3 or more, a sample is evaluated as having strong antimicrobial effects.

TABLE 1

| | | Ex. | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Blend amount (wt %) | Modacrylic fibers I | 55 | 55 | 55 | 55 | 55 | 55 | 55 | 55 | 0 | 0 | 55 |
| | Modacrylic fibers II | 0 | 0 | 0 | 0 | 0 | 0 | 0 | 0 | 55 | 55 | 0 |
| | Flame retardant rayon fibers | 20 | 35 | 20 | 30 | 20 | 15 | 15 | 15 | 20 | 0 | 0 |
| | Lyocell fibers | 17 | 0 | 15 | 0 | 10 | 15 | 10 | 15 | 17 | 37 | 37 |
| | Polyoxadiazole fibers | 8 | 10 | 10 | 15 | 15 | 15 | 20 | 15 | 8 | 8 | 8 |
| Spun yarn | Cotton count No. | 18/1 | 18/1 | 18/1 | 18/1 | 18/1 | 18/1 | 18/1 | 18/1 | 18/1 | 18/1 | 18/1 |
| Fabric | Basis weight (g/m$^2$) | 196 | 189 | 198 | 176 | 192 | 190 | 188 | 230 | 182 | 184 | 181 |
| | Knitting | Plain | Plain | Plain | Plain | Plain | Plain | Plain | Plain | Plain | Plain | Plain |
| Flame retardancy | Char length (mm) | 49 | 46 | 48 | 50 | 45 | 45 | 49 | 46 | 40 | 41 | 46 |
| | Afterflame time (second) | 0.0 | 0.0 | 0.0 | 0.0 | 0.0 | 0.0 | 0.0 | 0.0 | 0.0 | 0.0 | 0.0 |
| | Afterglow time (second) | 0.7 | 0.6 | 0.8 | 0.3 | 0.8 | 1.4 | 1.6 | 1.8 | 0.8 | 3.8 | 3.5 |
| Antimicrobial properties | Antimicrobial activity value A after washed 10 times | 5.9 | 5.9 | 5.9 | 5.9 | 5.9 | 5.9 | 5.9 | 5.9 | 5.9 | 5.9 | 5.9 |

TABLE 2

| | | Ex. | | | Comp. Ex. | | | | | | | |
|---|---|---|---|---|---|---|---|---|---|---|---|---|
| | | 12 | 13 | 14 | 1 | 2 | 3 | 4 | 5 | 6 | 7 | 8 |
| Blend amount (wt %) | Modacrylic fibers I | 20 | 50 | 55 | 55 | 50 | 55 | 20 | 0 | 0 | 55 | 0 |
| | Modacrylic fibers II | 0 | 0 | 0 | 0 | 0 | 0 | 0 | 0 | 0 | 0 | 15 |
| | Flame retardant rayon fibers | 35 | 20 | 17 | 40 | 10 | 0 | 0 | 55 | 55 | 10 | 0 |
| | Lyocell fibers | 0 | 0 | 0 | 0 | 10 | 0 | 35 | 37 | 0 | 0 | 0 |
| | Polyoxadiazole fibers | 45 | 30 | 28 | 5 | 30 | 45 | 45 | 8 | 45 | 35 | 85 |

TABLE 2-continued

| | | Ex. | | | Comp. Ex. | | | | | | | |
|---|---|---|---|---|---|---|---|---|---|---|---|---|
| | | 12 | 13 | 14 | 1 | 2 | 3 | 4 | 5 | 6 | 7 | 8 |
| Spun yarn | Cotton count No. | 18/1 | 18/1 | 18/1 | 18/1 | 18/1 | 18/1 | 18/1 | 18/1 | 18/1 | 18/1 | 18/1 |
| Fabric | Basis weight (g/m$^2$) | 180 | 170 | 196 | 184 | 164 | 180 | 180 | 180 | 180 | 180 | 180 |
| | Knitting | Plain | Plain | Plain | Plain | Plain | Plain | Plain | Plain | Plain | Plain | Plain |
| Flame retardancy | Char length (mm) | 42 | 44 | 44 | 130 | 44 | 49 | 40 | Fully charred | 46 | 43 | 41 |
| | Afterflame time (second) | 0.0 | 0.0 | 0.0 | 0.0 | 0.0 | 0.0 | 0.0 | Fully charred | 0.0 | 0.0 | 0.0 |
| | Afterglow time (second) | 1.9 | 0.8 | 0.7 | 0.6 | 5.0 | 10.8 | 6.2 | Fully charred | 0.4 | 4.8 | 12.4 |
| Antimicrobial properties | Antimicrobial activity value A after washed 10 times | 2.4 | 5.9 | 5.9 | 5.9 | 5.9 | 5.9 | 2.4 | 0.7 | 0.6 | 5.9 | 1.2 |

TABLE 3

| | | Ex. | | | | | Comp. Ex. |
|---|---|---|---|---|---|---|---|
| | | 15 | 16 | 17 | 18 | 19 | 9 |
| Blend amount (wt %) | Modacrylic fibers I | 55 | 55 | 55 | 55 | 55 | 55 |
| | Modacrylic fibers II | 0 | 0 | 0 | 0 | 0 | 0 |
| | Flame retardant rayon fibers | 20 | 20 | 20 | 20 | 20 | 20 |
| | Lyocell fibers | 17 | 15 | 10 | 15 | 10 | 20 |
| | Polyoxadiazole fibers | 8 | 10 | 15 | 10 | 15 | 5 |
| Spun yarn | Cotton count No. | 18/1 | 18/1 | 18/1 | 18/1 | 18/1 | 18/1 |
| Fabric | Basis weight (g/m$^2$) | 191 | 194 | 190 | 236 | 229 | 190 |
| | Weave | 2/1 twill | 2/1 twill | 2/1 twill | 2/1 twill | 2/1 twill | 2/1 twill |
| | Warp density (yarn/inch) | 70 | 70 | 70 | 90 | 90 | 70 |
| | Weft density (yarn/inch) | 50 | 50 | 50 | 70 | 70 | 50 |
| Flame retardancy | Char length (mm) warp direction/weft direction | 45/30 | 41/35 | 36/31 | 85/45 | 41/36 | 125/109 |
| | Afterflame time (second) warp direction/weft direction | 0.0/0.0 | 0.0/0.0 | 0.0/0.0 | 0.0/0.0 | 0.0/0.0 | 0.0/0.0 |
| | Afterglow time (second) warp direction/weft direction | 0.7/0.7 | 0.7/0.6 | 0.6/0.6 | 0.8/0.7 | 0.7/0.8 | 0.7/0.8 |
| Antimicrobial properties | Antimicrobial activity value A after washed 10 times | 5.9 | 5.9 | 5.9 | 5.9 | 5.9 | 5.9 |

40

TABLE 4

| | | Ex. 20 | Ex. 21 | Ex. 22 | Comp. Ex. 10 | Comp. Ex. 11 |
|---|---|---|---|---|---|---|
| Blend amount (wt %) | Modacrylic fibers I | 40 | 40 | 0 | 50 | 0 |
| | Modacrylic fibers II | 0 | 0 | 35 | 0 | 40 |
| | Flame retardant rayon fibers | 30 | 30 | 30 | 30 | 0 |
| | Lyocel | 0 | 0 | 0 | 0 | 40 |
| | Meta-aramid fibers | 30 | 30 | 35 | 20 | 20 |
| Spun yarn | Cotton count No. | 40/2 | 32/2 | 32/2 | 36/2 | 36/2 |
| Fabric | Basis weight (g/m$^2$) | 170 | 210 | 210 | 170 | 210 |
| | Weave | Plain | 2/1 twill | 2/1 twill | Plain | 2/1 twill |
| | Warp density (yarn/inch) | 66 | 71 | 71 | 66 | 71 |
| | Weft density (yarn/inch) | 61 | 56 | 56 | 61 | 56 |
| Flame retardancy | Char length (mm) warp direction/weft direction | 94/98 | 98/86 | 41/30 | 105/103 | 108/115 |
| | Afterflame time (second) warp direction/weft direction | 0.0/0.0 | 0.0/0.0 | 0.0/0.0 | 0.0/0.0 | 0.0/0.0 |
| | Afterglow time (second) warp direction/weft direction | 0.8/0.7 | 1.0/0.9 | 1.2/0.9 | 0.8/0.7 | 4.3/4.1 |
| Antimicrobial properties | Antimicrobial activity value A after washed 10 times | 4.9 | 4.9 | 4.2 | 5.9 | 4.8 |

TABLE 5

| | | Ex. | | | | | | | Comp. Ex. |
|---|---|---|---|---|---|---|---|---|---|
| | | 23 | 24 | 25 | 26 | 27 | 28 | 29 | 12 |
| Blend amount (wt %) | Modacrylic fibers II | 40 | 35 | 35 | 30 | 30 | 30 | 30 | 40 |
| | Flame retardant rayon fibers | 30 | 30 | 30 | 30 | 30 | 30 | 30 | 0 |
| | Lyocel | 0 | 0 | 0 | 0 | 0 | 0 | 0 | 40 |
| | Meta-aramid fibers | 30 | 35 | 30 | 40 | 30 | 25 | 20 | 20 |
| | Para-aramid fibers | 0 | 0 | 5 | 0 | 10 | 15 | 20 | 0 |
| Spun yarn | Cotton count No. | 18/1 | 18/1 | 18/1 | 18/1 | 18/1 | 18/1 | 18/1 | 18/1 |
| Fabric | Basis weight (g/m$^2$) | 170 | 170 | 170 | 170 | 170 | 170 | 170 | 170 |
| | Knitting | Plain | Plain | Plain | Plain | Plain | Plain | Plain | Plain |
| Flame retardancy | Char length (mm) | 92 | 83 | 78 | 98 | 73 | 77 | 24 | 112 |
| | Afterflame time (second) | 0.0 | 0.0 | 0.0 | 0.0 | 0.0 | 0.0 | 0.0 | 0.0 |
| | Afterglow time (second) | 1.1 | 1.2 | 0.9 | 1.2 | 0.7 | 0.7 | 0.9 | 4.5 |
| Antimicrobial properties | Antimicrobial activity value A after washed 10 times | 5.9 | 5.9 | 5.9 | 5.9 | 5.9 | 5.9 | 5.9 | 5.9 |

TABLE 6

| | | Ex. | | | | | | | Comp. Ex. |
|---|---|---|---|---|---|---|---|---|---|
| | | 30 | 31 | 32 | 33 | 34 | 35 | 36 | 13 |
| Blend amount (wt %) | Modacrylic fibers I | 40 | 40 | 30 | 40 | 30 | 30 | 30 | 50 |
| | Flame-retardant rayon fibers | 30 | 30 | 30 | 20 | 30 | 30 | 30 | 30 |
| | Lyocel | 0 | 0 | 0 | 0 | 0 | 0 | 0 | 0 |
| | Meta-aramid fibers | 30 | 20 | 30 | 30 | 40 | 25 | 20 | 20 |
| | Para-aramid fibers | 0 | 10 | 10 | 10 | 0 | 15 | 20 | 0 |
| Spun yarn | Cotton count No. | 18/1 | 18/1 | 18/1 | 18/1 | 18/1 | 18/1 | 18/1 | 18/1 |
| Fabric | Basis weight (g/m$^2$) | 170 | 170 | 170 | 170 | 170 | 170 | 170 | 170 |
| | Knitting | Plain | Plain | Plain | Plain | Plain | Plain | Plain | Plain |
| Flame retardancy | Char length (mm) | 96 | 86 | 66 | 90 | 81 | 66 | 23 | 104 |
| | Afterflame time (second) | 0.0 | 0.0 | 0.0 | 0.0 | 0.0 | 0.0 | 0.0 | 0.0 |
| | Afterglow time (second) | 1.2 | 1.1 | 1 | 1.2 | 1.2 | 0.7 | 1.2 | 1.2 |
| Antimicrobial properties | Antimicrobial activity value A after washed 10 times | 5.9 | 5.9 | 5.9 | 5.9 | 5.9 | 5.9 | 5.9 | 5.9 |

As is clear from the results shown in Tables 1 to 6 above, the char lengths, afterflame times, and afterglow times of the fabrics of the examples measured using the flammability test in accordance with GB/P 5455-1997 were 100 mm or less, 2 seconds or less, and 4 seconds or less, respectively, and these fabrics had excellent flame retardancy. Also, the antimicrobial activity values A of the fabrics of the examples measured using the antimicrobial test in accordance with IS020743 were 2 or more, and these fabrics had antimicrobial properties.

The char lengths of the fibers of Examples 1 to 17, 19, 22, 29 and 36 measured using the flammability test in accordance with GB/T 5455-1997 were 50 mm or less, and these fibers had higher flame retardancy. Also, the char lengths, afterflame times, and afterglow times of the fibers of Examples 1 to 9, 12 to 17, 19, 22, 29 and 36 measured using the flammability test in accordance with GB/r 5455-1997 were 50 mm or less, 2 seconds or less, and 2 seconds or less, respectively, and these fibers had even higher flame retardancy.

The antimicrobial activity values A of the fibers of Examples 1 to 11 and 13 to 36 measured using the antimicrobial test in accordance with IS020743 were 3 or more, and these fibers had strong antimicrobial effects.

As is clear from the comparison between Example 11 and Example 13, when the content of the polyoxadiazole fibers is 30 wt % or more, the content of the flame-retardant rayon fibers is preferably 20 wt % or more, and when the content of the polyoxadiazole fibers is less than 30 wt %, the flame-retardant rayon fibers need not be included.

As is clear from the comparison of Examples 26 to 29 and the comparison of Examples 34 to 36, when the contents of aramid fibers were the same, the char length further decreased and the flame retardancy was further improved when meta-aramid fibers and para-aramid fibers were used together, and a particularly short char length and particularly high flame retardancy were achieved as the mass ratio between the meta-aramid fibers and the para-aramid fibers (meta: para) was close to 1:1.

The present invention includes one or more embodiments below, for example, but there is no particular limitation thereto.

[1] A flame-retardant fabric comprising modacrylic fibers;

regenerated cellulose fibers; and heat-resistant fibers, wherein the regenerated cellulose fibers comprise one or more regenerated cellulose fibers selected from the group consisting of flame-retardant rayon fibers and lyocell fibers, the heat-resistant fibers comprise one or more heat-resistant fibers selected from the group consisting of polyoxadiazole fibers and aramid fibers, the flame-retardant fabric comprises the modacrylic fibers in an amount of 20 to 76 wt %, the regenerated cellulose fibers in an amount of 11 to 48 wt %, and the heat-resistant fibers in an amount of 6 to 69 wt %, and a char length, afterflame time, and afterglow time of the flame-retardant fabric measured using a flammability test in accordance with GB/P 5455-1997 are 100 mm or less, 2 seconds or less, and 4 seconds or less, respectively.

[2] The flame-retardant fabric according to [1], wherein the modacrylic fibers comprise an acrylonitrile copolymer that comprises acrylonitrile in an amount of 35 to 85 wt %, one or more halogen-containing monomers selected from the group consisting of halogen-containing vinyl monomers and halogen-containing vinylidene monomers in an amount of 15 to 65 wt %, and a vinyl monomer having a sulfonic group in an amount of 3 wt % or less.

[3] The flame-retardant fabric according to [1] or [2], wherein the modacrylic fibers comprise an antimony compound in an amount of 3.9 to 20 wt %.

[4] The flame-retardant fabric according to any one of [1] to [3], wherein the flame-retardant rayon fibers comprise a phosphorus-based flame retardant.

[5] The flame-retardant fabric according to any one of [1] to [4], wherein the flame-retardant fabric comprises the modacrylic fibers in an amount of 20 to 76 wt %, the regenerated cellulose fibers in an amount of 17 to 48 wt %, and the polyoxadiazole fibers in an amount of 6 to 63 wt %.

[6] The flame-retardant fabric according to any one of [1] to [5], wherein the flame-retardant fabric comprises the modacrylic fibers in an amount of 20 to 76 wt %, the flame-retardant rayon fibers in an amount of 15 to 25 wt %, the lyocell fibers in an amount of 10 to 20 wt %, and the polyoxadiazole fibers in an amount of 6 to 62 wt %.

[7] The flame-retardant fabric according to any one of [1] to [4], wherein the flame-retardant fabric comprises the modacrylic fibers in an amount of 20 to 52 wt %, the flame-retardant rayon fibers in an amount of 17 to 48 wt %, and the aramid fibers in an amount of 30 to 63 wt %, with meta-aramid fibers being included in an amount of 20 wt % or more as the aramid fibers.

[8] The flame-retardant fabric according to any one of [1] to [7], wherein a char length, afterflame time, and afterglow time of the flame-retardant fabric measured using a flammability test in accordance with GB/T 5455-1997 are 50 mm or less, 2 seconds or less, and 2 seconds or less, respectively.

[9] The flame-retardant fabric according to any one of [1] to [8], wherein an antimicrobial activity value A of the flame-retardant fabric measured using an antimicrobial test in accordance with IS020743 after the flame-retardant fabric is washed 10 times is 3 or more.

[10] Protective clothing made of the flame-retardant fabric accord ng to any one of [1] to [9].

The invention claimed is:

1. A flame-retardant fabric comprising:

modacrylic fibers;

regenerated cellulose fibers; and heat-resistant fibers, wherein the regenerated cellulose fibers comprise one or more regenerated cellulose fibers selected from the group consisting of flame-retardant rayon fibers and lyocell fibers, the heat-resistant fibers comprise one or more heat-resistant fibers selected from the group consisting of polyoxadiazole fibers and aramid fibers, the flame-retardant fabric comprises the modacrylic fibers in an amount of 20 to 76 wt %, the regenerated cellulose fibers in an amount of 17 to 48 wt %, and the polyoxadiazole fibers in an amount of 6 to 63 wt %, and a char length, afterflame time, and afterglow time of the flame-retardant fabric measured using a flammability test in accordance with GB/T 5455-1997 are 100 mm or less, 2 seconds or less, and 4 seconds or less, respectively.

2. The flame-retardant fabric according to claim 1, wherein the modacrylic fibers comprise an acrylonitrile copolymer that comprises acrylonitrile in an amount of 35 to 85 wt %, one or more halogen-containing monomers selected from the group consisting of halogen-containing vinyl monomers and halogen-containing vinylidene monomers in an amount of 15 to 65 wt %, and a vinyl monomer having a sulfonic group in an amount of 3 wt % or less.

3. The flame-retardant fabric according to claim 1, wherein the modacrylic fibers comprise an antimony compound in an amount of 3.9 to 20 wt %.

4. The flame-retardant fabric according to claim 1, wherein the flame-retardant rayon fibers comprise a phosphorus-based flame retardant.

5. The flame-retardant fabric according to claim 1, wherein the flame-retardant fabric comprises the modacrylic fibers in an amount of to 76 wt %, the flame-retardant rayon fibers in an amount of 15 to 25 wt %, the lyocell fibers in an amount of 10 to 20 wt %, and the polyoxadiazole fibers in an amount of 6 to 62 wt %.

6. The flame-retardant fabric according to claim 1, wherein a char length, afterflame time, and afterglow time of the flame-retardant fabric measured using a flammability test in accordance with GB/T 5455-1997 are 50 mm or less, 2 seconds or less, and 2 seconds or less, respectively.

7. The flame-retardant fabric according to claim 1, wherein an antimicrobial activity value A of the flame-retardant fabric measured using an antimicrobial test in accordance with ISO20743 after the flame-retardant fabric is washed 10 times is 3 or more.

8. Protective clothing made of the flame-retardant fabric according to claim 1.

9. The protective clothing according to claim 8, wherein the modacrylic fibers comprise an acrylonitrile copolymer that comprises acrylonitrile in an amount of 35 to 85 wt %, one or more of halogen-containing monomers selected from the group consisting of halogen-containing vinyl monomers and halogen-containing vinylidene monomers in an amount of 15 to 65 wt %, and a vinyl monomer having a sulfonic group in an amount of 3 wt % or less.

10. The protective clothing according to claim 8, wherein the modacrylic fibers comprise an antimony compound in an amount of 3.9 to 20 wt %.

11. The protective clothing according to claim 8, wherein the flame-retardant rayon fibers comprise a phosphorus-based flame retardant.

12. The protective clothing according to claim 8, wherein the flame-retardant fabric comprises the modacrylic fibers in an amount of to 76 wt %, the flame-retardant rayon fibers in an amount of 15 to 25 wt %, the lyocell fibers in an amount of 10 to 20 wt %, and the polyoxadiazole fibers in an amount of 6 to 62 wt %.

13. The protective clothing according to claim 8, wherein a char length, afterflame time, and afterglow time of the flame-retardant fabric measured using a flammability test in accordance with GB/T 5455-1997 are 50 mm or less, 2 seconds or less, and 2 seconds or less, respectively.

14. The protective clothing according to claim 8, wherein an antimicrobial activity value A of the flame-retardant fabric measured using an antimicrobial test in accordance with ISO20743 after the flame-retardant fabric is washed 10 times is 3 or more.

* * * * *